United States Patent [19]

Leiker

[11] 4,302,960

[45] Dec. 1, 1981

[54] PORTABLE HOSE FITTING CRIMPING DEVICE

[75] Inventor: Dale H. Leiker, Manitowoc, Wis.

[73] Assignee: Gould Inc., Rolling Meadows, Ill.

[21] Appl. No.: 87,966

[22] Filed: Oct. 25, 1979

[51] Int. Cl.[3] ..... B21D 41/04

[52] U.S. Cl. ..... 72/402; 72/454

[58] Field of Search ..... 72/402, 454, 453.15; 29/237

[56] References Cited

U.S. PATENT DOCUMENTS

| | | | |
|---|---|---|---|
| Re. 29,802 | 10/1978 | Whitledge | 29/237 |
| 160,696 | 3/1875 | Morse | 29/237 |
| 187,875 | 2/1877 | Loring | 29/237 |
| 382,776 | 5/1888 | Sibley | 29/237 |
| 2,916,812 | 12/1959 | Milo | 29/237 |
| 3,785,050 | 1/1974 | Whitledge | 29/237 |
| 3,805,580 | 4/1974 | Leiker | 29/237 |
| 3,858,298 | 1/1975 | Whitledge | 29/237 |

*Primary Examiner*—Gene P. Crosby

*Attorney, Agent, or Firm*—George P. Edgell; Kay H. Pierce; Edward E. Sachs

[57] ABSTRACT

A portable hose fitting crimping machine using an interchangeable cartridge die assembly in conjunction with a portable framework so as to provide for an efficient means for crimping hoses and couplings of different sizes without reliability and calibration problems.

6 Claims, 3 Drawing Figures

PORTABLE HOSE FITTING CRIMPING DEVICE

BACKGROUND AND SUMMARY OF INVENTION

This invention relates to portable hose fitting crimping machine and, more particularly, to a device portable in nature and extremely, reliable but simple in operation.

Over the years, a great many devices have been employed for crimping couplings or other fittings onto flexible hoses and the like. Illustrative of the prior art is my earlier U.S. Pat. No. 3,805,580. In that patent, apparatus is disclosed employing hydraulic fluid for developing the necessary axial crimping action. In addition, gauges and indicators are provided and preset to carefully monitor the degree of crimping so that the ultimately connected fitting is properly joined to the hose, i.e., not too loosely nor, on the other hand, overly tight with the prospect of possible premature failure under stress.

This dilemma and also the complexity of the problem have all been avoided by the practice of the instant invention. Through the provision of a compact, sturdy yet simple and portable device, I have made it possible for artisians in the field to develop extremely satisfactory crimp joints without the need of the complex mechanism of the prior art. The novel invention may be advantageously hand carried to a work site and operated without employing any outside force other than hand power.

An important feature of the invention is the use of a cartridge die assembly which is employed in conjunction with a portable framework and which is removable so as to adapt the overall portable framework to hoses and couplings of different size and design. Crimping is attained without presetting gauges or monitoring diameters. In one preferred embodiment of the invention, the cartridge is mounted in a stationary position, releasably within the overall housing and a novel ball screw, thrust bearing arrangement employed movably within the housing so as to bring a crimping action against the movable die portions of the cartridge.

DETAILED DESCRIPTION OF THE INVENTION

Figure 1:
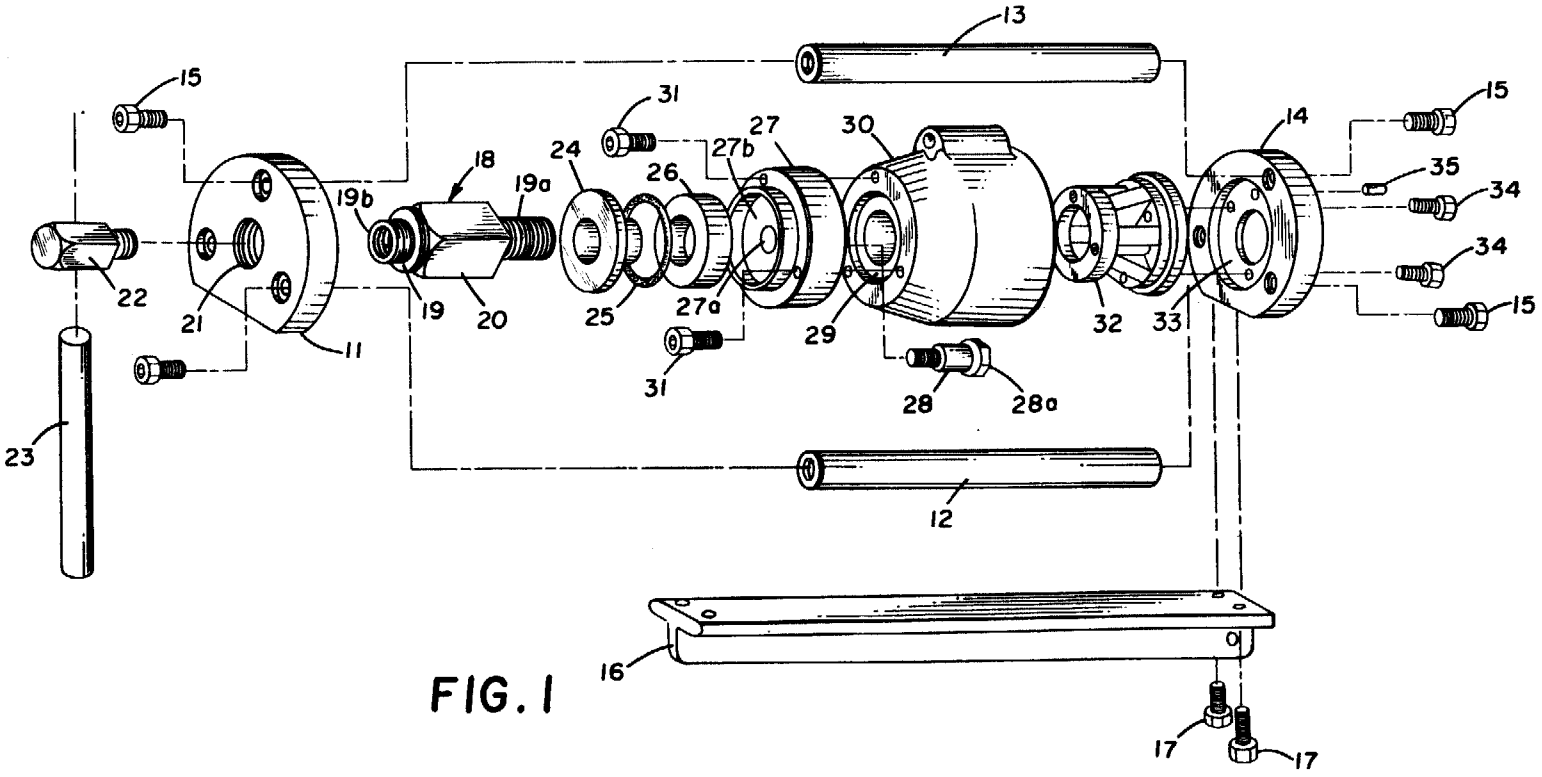
FIG. 1 is an exploded, perspective view of the novel portable hose fitting crimping device.
Figure 2:
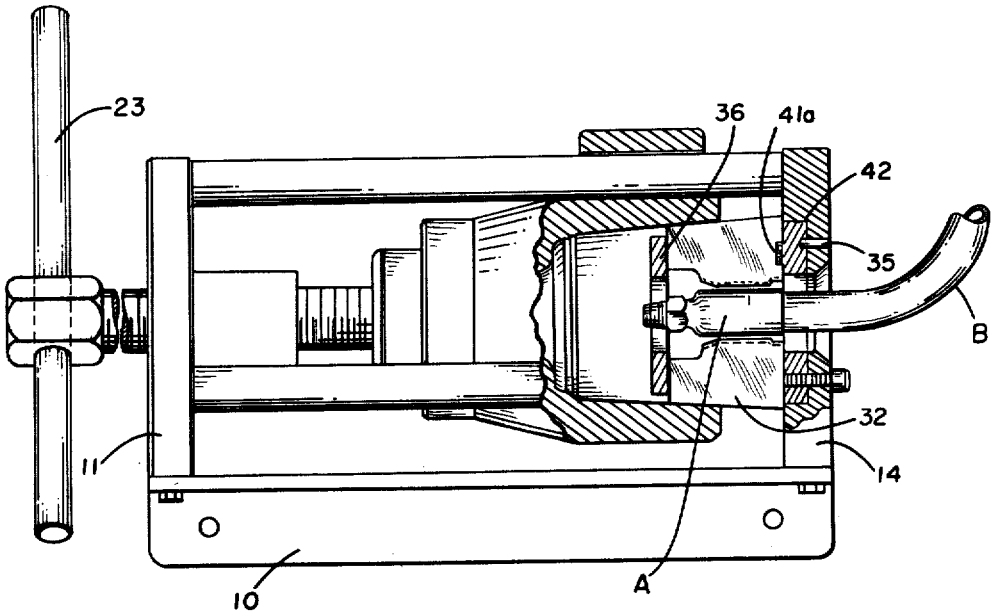
FIG. 2 is a side view of the invention.

In FIGS. 1, 2 the numeral 10 designates generally a frame for the hose fitting crimping device. Frame 10 includes a top plate 11, tie rods 12 and 13, (a third tie rod and connecting means not shown) and bottom plate 14 - the tie rods interconnecting top plate 11 to bottom plate 14 via socket head cap screws 15. A mounting bracket 16 is connected to the flat side edges of top plate 11 and bottom plate 14 by hexagonal head cap screws 17. Mounting bracket 16 may be used to secure frame 10 on a bench, particularly in a bench vise.

Figure 3:
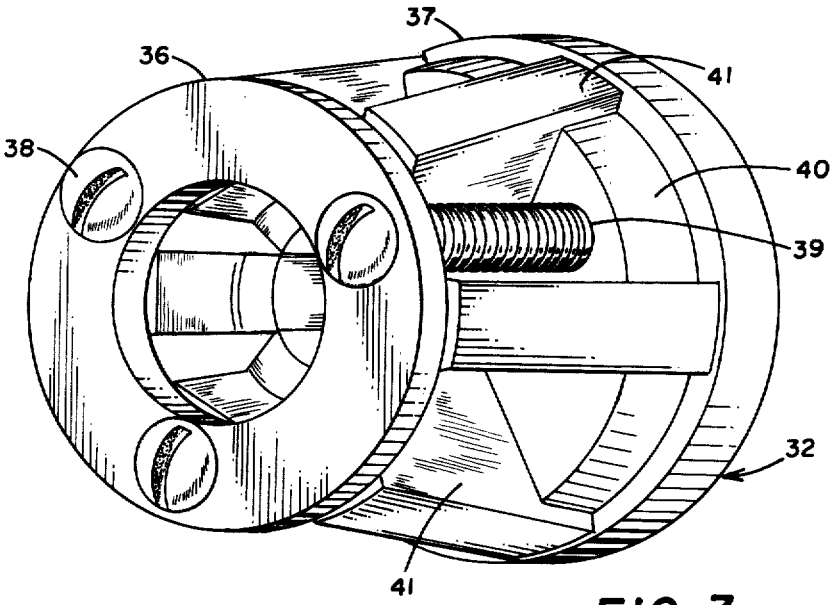
FIG. 3 is a perspective view of the die cartridge assembly which is an integral part of the crimping device.

Ball screw and nut assembly 18 is positioned in the power end of the frame 10 and serves to transmit power to the die cartridge assembly which performs the crimping. Assembly 18 includes screw 19, nut 20, and balls (not shown). The balls act as an interface or inner lock between the exterior of screw 19 and the stationary nut 20. Grooves 19*a* defined on the exterior of the screw 19 as disclosed at 60 degree angles interface with the balls to enable screw 19 to pass through nut 20 when screw 19 is rotated. The end of screw 19 passes through bore 21 whereupon its threaded recess 19*a* is coupled to the male threaded portion of hexagonal drive screw 22. Turn bar 23 is slidably mounted through hexagonal drive 22 and is used to provide hand power rotational force to screw 19. The right hand end of screw 19 extends into ball screw adaptor 24. Ball screw adaptor 24 is sealably interfaced by O-ring 25 against thrust bearing 26 which itself is seated in the flanged recess 27*b* of bearing housing 27. A hexagonal head left hand shoulder screw 28 is coupled to the threaded recess of screw 19, and the head 28*a* of shoulder screw 28 extends from screw 19 through ball screw adaptor 24, thrust bearing 26, through bore 27*a* of bearing housing 27, and into aperture 29 of crimping bowl 30. Crimping bowl 30 is mounted against bearing housing 27 by socket head cap screws 31. The elements 18–31 thus serve as a power or drive train to operate the die cartridge assembly (see also FIG. 3) in performing the crimping action.

Die cartridge assembly 32 is mounted in the annular recess 33 of bottom plate 14 by socket head cap screws 34. Die cartridge assembly 32 is properly aligned with bottom plate 14 via locating pin 35 which interfaces both the die cartridge and the bottom plate. The front or smaller end of the die cartridge assembly 32 extends into the mouth of the crimping bowl 30. Die cartridge assembly 32 may be mounted and removed without disengaging bottom plate 14 from tie rods.

Die cartridge assembly 32 (see FIGS. 2 and 3) includes a die cover 36 and a die holder 37 which are interconnected by mounting screws 38 extending through spacers 39 and into wedge portions 40 of die holder 37. A set of discs 41 are slidably mounted between die cover 36 and die holder 37 by roll pins 41*a* (see FIG. 2) which extend into recesses 41*a* of the dies 41. When the dies are slid inwardly towards an imaginary axis of the die holder assembly, the exterior surface of the die holder assembly defines a conical section and the interior surface defines generally a cylindrical section. The annular mating of the dies to form a cylindrical section acts to crimp a coupling portion to a hose. The outer surface of the die cartridge assembly interfaces the interior wall of the crimping bowl when the crimping bowl contacts the bottom plate.

OPERATION

The crimping device is ready for operation once the frame 10 has been immobilized by placing mounting bracket 16 in a vise. A suitably sized die cartridge assembly is selected for the particular hose size. The assembly is properly positioned when locating pin 35 is mounted to align the assembly to bottom plate 14. Hose A and coupling B may be axially positioned within die cartridge assembly 32 and properly aligned with crimping dies 41. Thereafter, the user hand rotates the actuator or turn bar 23 in a clockwise direction. This acts to advance screw 19 further into frame 10 and ultimately advances crimping bowl 30 towards bottom plate 14. As the crimping bowl advances towards bottom plate 14, the matching angles on crimping bowl 30 and crimping dies 41 force the crimping dies inwardly to crimp the coupling A onto the hose B. Once the crimping bowl makes contact with the face of bottom plate 14, the crimping is completed. Thereafter, actuator bar 23 is rotated counter clockwise to remove radial pressure on the dies 41 whereupon the crimped coupling can be removed from the die cartridge assembly. This process may be repeated for the next coupling and hose assembly. If the user wishes to crimp a different sized coupling and hose, the bowl 30 is retracted to clear the cartridge and die cartridge assembly may be simply removed and replaced with an appropriately sized assembly.

While in the foregoing specification a detailed description of a specific embodiment of the invention was set forth for the purpose of illustration, will be understood that many details given herein may be varied considerably by those skilled in the art without departing from the spirit and scope of the invention.

I claim:

1. Apparatus for crimping a coupling to a hose comprising a relatively elongated portable frame having a first end plate apertured to receive a portion of said hose with said fitting uncrimpedly mounted thereon, a second end plate on said frame having a threaded bore extending longitudinally therethrough, a thrust screw mounted in said bore and movable axially therein to position one screw end interiorily of said frame, said thrust screw end being equipped with a connection for mounting crimping cam means, said first end plate also being equipped with a connection for mounting crimping cam means, a camming crimping bowl mounted on one said connectors and a camming crimping cartridge removably mounted on the other of said connectors, said cartridge including a first plate in combination with a second plate for supporting a plurality of dies movable radially inward of said axis to crimp said fitting and being readily removable for replacement to crimp a different diameter fitting.

2. The structure of claim 1 in which the bowl is sized relative to the distance between the end plates so as to contact one of said end plates when crimping is complete whereby no gauging is required for achieving predetermined crimping diameters.

3. The structure of claim 1 in which said bowl is connected to said thrust screw and a ball thrust bearing is interposed therebetween.

4. The structure of claim 1 in which said cartridge includes guide means for constraining die movement perpendicularly of said frame.

5. The structure of claim 1 in which the crimping bowl is so sized relative to said cartridge and the distance between said first end plate as to provide a recess to accomodate said fitting while also achieving full crimp when contacting one said end plates.

6. Apparatus for crimping a coupling to a hose comprising:

a relatively elongated portable frame including a first end plate apertured to receive a portion of said hose with said fitting uncrimpedly mounted thereon, a second end plate having a threaded bore extending longitudinally therethrough, and a pair of tie rods interconnecting said first and second end plates;

a thrust screw mounted in said threaded bore and movable axially therein to position one screw end interiorly of said frame and the other screw end exteriorly of said frame;

a turn bar and nut assembly connected to said exterior screw end for axially moving said screw;

a shoulder screw connected to said interior screw end;

a thrust bearing assembly in combination with said interior screw end and said shoulder screw for providing drive power to a crimping cam means, said thrust bearing assembly including a thrust bearing seated in a bearing housing and adaptor means between said interior screw end and said thrust bearing, said shoulder screw extending through said adaptor means and said thrust bearing into said bearing housing;

a camming crimping bowl mounted on said bearing housing;

and a camming crimping cartridge removably mounted on said first end plate, said cartridge including a first plate in combination with a second plate for supporting a plurality of dies movable radially inward of said axis to crimp said fitting and being readily removable for replacement to crimp a different diameter fitting.

* * * * *